US006543369B1

(12) United States Patent
Swensson et al.

(10) Patent No.: US 6,543,369 B1
(45) Date of Patent: Apr. 8, 2003

(54) COMBINATION BEDSIDE AND OVERBED TABLE

(75) Inventors: Earl S. Swensson, Franklin, TN (US); David S. Gilbert, Mt. Juliet, TN (US)

(73) Assignee: Wellness, LLC, Nashville, TN (US)

( * ) Notice: Subject to any disclaimer, the term of this patent is extended or adjusted under 35 U.S.C. 154(b) by 0 days.

(21) Appl. No.: 09/777,428

(22) Filed: Feb. 6, 2001

(51) Int. Cl.[7] ..... A47B 23/00
(52) U.S. Cl. ..... 108/49; 108/103
(58) Field of Search ..... 100/49, 94, 103, 100/95

(56) References Cited

U.S. PATENT DOCUMENTS

| | | | | |
|---|---|---|---|---|
| 910,585 | A | * | 1/1909 | Robinson |
| 1,653,657 | A | | 12/1927 | Pretsch |
| 2,193,647 | A | * | 3/1940 | Rush et al. |
| 2,535,112 | A | | 12/1950 | Woody |
| 2,605,155 | A | * | 7/1952 | Lewis |
| 2,612,422 | A | * | 9/1952 | Sarkus |
| 2,663,608 | A | | 12/1953 | Schauer |
| 2,681,840 | A | * | 6/1954 | Miller |
| 2,749,197 | A | | 6/1956 | Smith |
| 3,538,862 | A | * | 11/1970 | Patriarca |
| 3,908,565 | A | | 9/1975 | Burnett |
| 4,401,036 | A | * | 8/1983 | Russo et al. |
| 4,542,936 | A | | 9/1985 | Gafken |
| 5,129,702 | A | * | 7/1992 | Ervin |
| 5,144,898 | A | | 9/1992 | Posly |
| 5,359,741 | A | | 11/1994 | Lang |
| D363,492 | S | | 10/1995 | Brüssing |
| 5,473,997 | A | | 12/1995 | Solomon et al. |
| 5,562,049 | A | | 10/1996 | Hoffman et al. |
| 5,606,917 | A | | 3/1997 | Cauffiel |
| 6,142,559 | A | * | 11/2000 | Sorel et al. |

FOREIGN PATENT DOCUMENTS

GB 2197584 A * 5/1988

OTHER PUBLICATIONS

Also included is a brochure entitled "Vista Bedside Cabinet", which shows a typical conventional bedside table (Undated But Admitted To Be Prior Art).
Declaration of H. Bart Franey (not prior art).

* cited by examiner

*Primary Examiner*—Jose V. Chen
(74) *Attorney, Agent, or Firm*—Waddey & Patterson; Lucian Wayne Beavers

(57) ABSTRACT

A combination bedside and overbed table apparatus includes a base, a column, a table attached to the column, and a lateral support system including a support arm outrigger support for increasing the lateral stability of the apparatus when the table is extended over the side of the base. The table is movable upon the column through a range of vertical and pivotal motion. The table has three basic positions including a bedside position wherein the table overlies the base, an upper range of positions known as "overbed" positions, in which the table is raised, and a reading position, wherein the table is located at a lower elevation than it is in its bedside position to allow ease of placement of the table over a chair or the like to provide a reading table.

15 Claims, 12 Drawing Sheets

COMBINATION BEDSIDE AND OVERBED TABLE

This application claims benefit of U.S. patent application Ser. No. 09/354,512 filed Jul. 15, 1999, entitled "Combination Bedside and Overbed Table" now abandoned.

BACKGROUND OF THE INVENTION

1. Field of the Invention

The present invention relates generally to an articulated table having a plurality of positions and a novel support structure, and more particularly, to such a table designed for alternative use as either a bedside or overbed table in a patient hospital environment.

2. Description of the Prior Art

Traditional hospital furniture includes both bedside tables and overbed tables which have been separate components.

The conventional bedside table is typically just a small cabinet which may be mounted on casters to make it mobile.

The traditional overbed table includes a base member which will extend under the bed, a column which extends up beside the bed, and a table top which extends over the base member. Thus, to locate the table over the bed, the base must be moved to a position under the bed. Such a traditional overbed table is provided for example by the PatientMate® overbed table available from Hill-Rom Company.

One attempt at a partial improvement on overbed tables was suggested in U.S. Pat. No. 3,908,565 to Burnett which describes therein a transportable overbed table. The overbed table of Burnett, however, still permanently overlies its base, and to move the table into a position over the bed, the entire base must be rotated. The Burnett device does include drawer units which may rotate relative to the base.

Another attempt at an articulated table is shown in U.S. Pat. No. 5,606,917 to Cauffiel. The Cauffiel table is not intended for use with a hospital bed, but instead is designed for use with a chair, couch or the like wherein the base of the Cauffiel apparatus is located under and held in place by the legs of the chair.

Accordingly, there is still a need for an improved overbed table which is flexible in its usage and which can be readily controlled by a patient lying in the bed.

SUMMARY OF THE INVENTION

A combination bedside and overbed table apparatus is provided. The apparatus includes a base mounted on a support structure, a telescoping column extending upward from the base, and a table attached to the upper end of the column. The table is movable at least between a bedside position located directly over the base, and an overbed position wherein the table is elevated and is rotated about the column relative to the base, so that in the overbed position, the table overhangs the base so that the table extends over the bed. The support structure is designed to cooperatively operate with the table movements to provide lateral support to the base when the table overhangs the base.

Preferably, the table and support structure are also movable relative to the base to place the table in a lower reading position, located below the conventional bedside position, and rotated relative to the base so that the table and the support structure may extend away from the base and away from the bed. This allows the table to be placed in a position adjacent to a bedside chair where the table can be used as a reading table.

When the table is in its bedside position, it preferably is locked into position where it directly overlies the base.

When the table is moved to its upper overbed position, the table is adjustable within a vertical range, and is also adjustment within a pivotal range relative to the base. The support structure is also adjustable within a pivotal range relative to the base to provide a corresponding lateral support to the base when the table is extended over the base.

When the table is in its lower reading position, it also is adjustable through a vertical range, and through a pivotal range. The pivotal range of adjustment when the table is in the reading position is at least partially non-coincident with the pivotal range of the table when the table is in its overbed position.

The apparatus includes a releasable locking mechanism on the column, which is readily accessible by a patient lying in the bed, so that the patient may release the column and easily move the table vertically between its various positions.

The table top also has built therein a dual axis lateral adjustment which allows the table to slide in both x and y directions relative to a table supporting structure. This, in combination with the vertical adjustment and pivotal adjustment, allows a wide range of position adjustment of the table so that it may be readily positioned at the desired location by the patient.

The table top includes a second releasing mechanism associated with the lateral positioning of the table top relative to the supporting structure, which second releasing mechanism is also readily accessible and operable by a patient lying in the bed.

It is therefore an object of the present invention to provide a combined bedside and overbed table.

Another object of the present invention is the provision of an adjustable overbed table which may be readily adjusted by a patient lying in the bed.

Still another object of the present invention is the provision of a combination bedside and overbed table which can also alternatively be utilized as a reading table by a person sitting in a chair in the hospital room.

Still another object of the present invention is the provision of a combination bedside and overbed table which is simple and economical of construction, and which is safe and easy to operate.

Yet a further object of the present invention is the provision of a combination bedside and overbed table with a lateral support structure to improve the lateral stability and counteract the cantilever forces of the extended table.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The Base Cabinet

Figure 1:
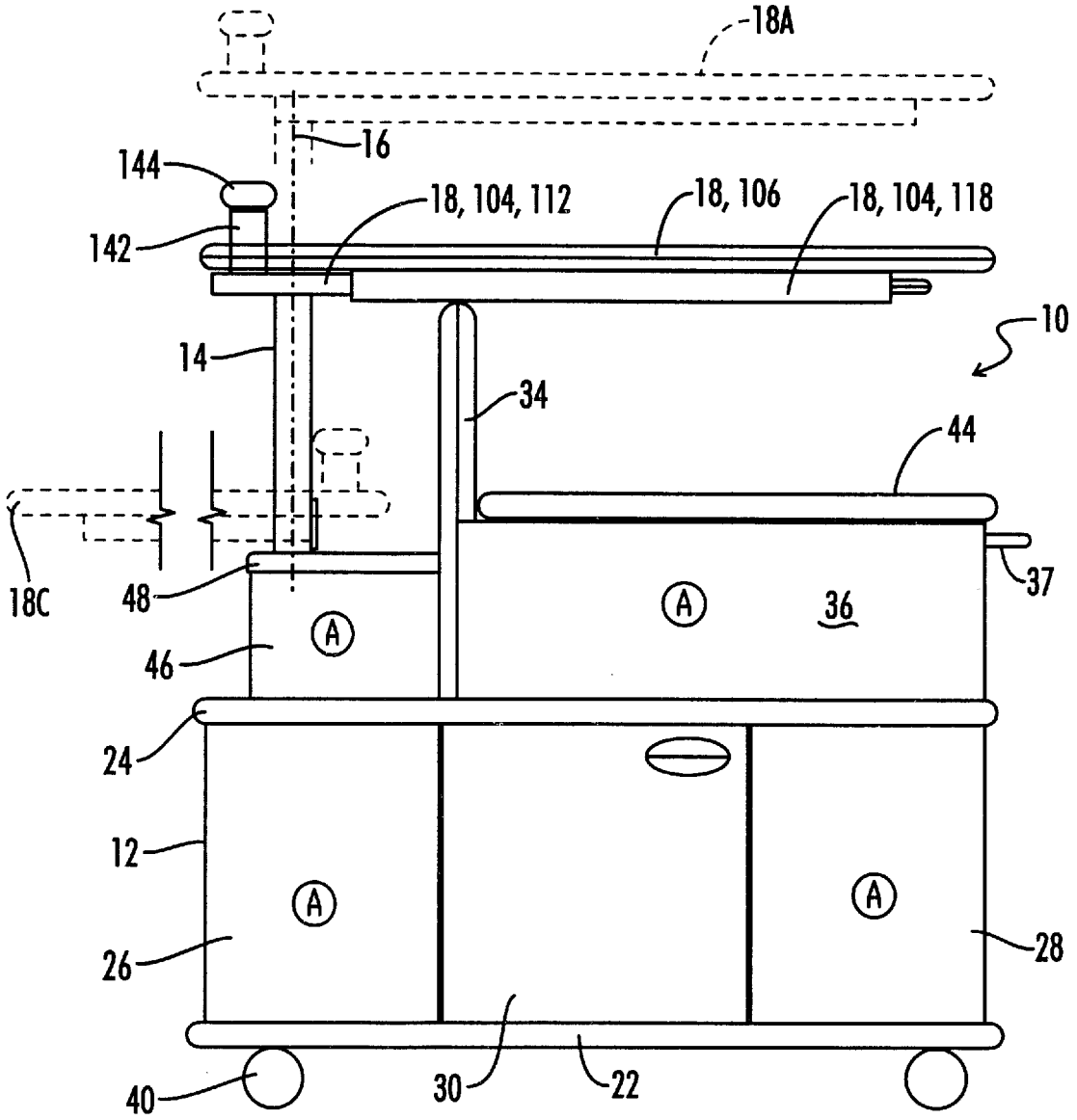
FIG. 1 is a side elevation view of the combination bedside and overbed table.

Referring now to the drawings, and particularly to FIG. 1, a combination bedside and overbed table apparatus is shown and generally designated by the numeral 10. The apparatus 10 includes a base 12, a column 14 extending upward from the base and having a vertical axis 16, and a table 18 attached to the column 14.

Figure 4:
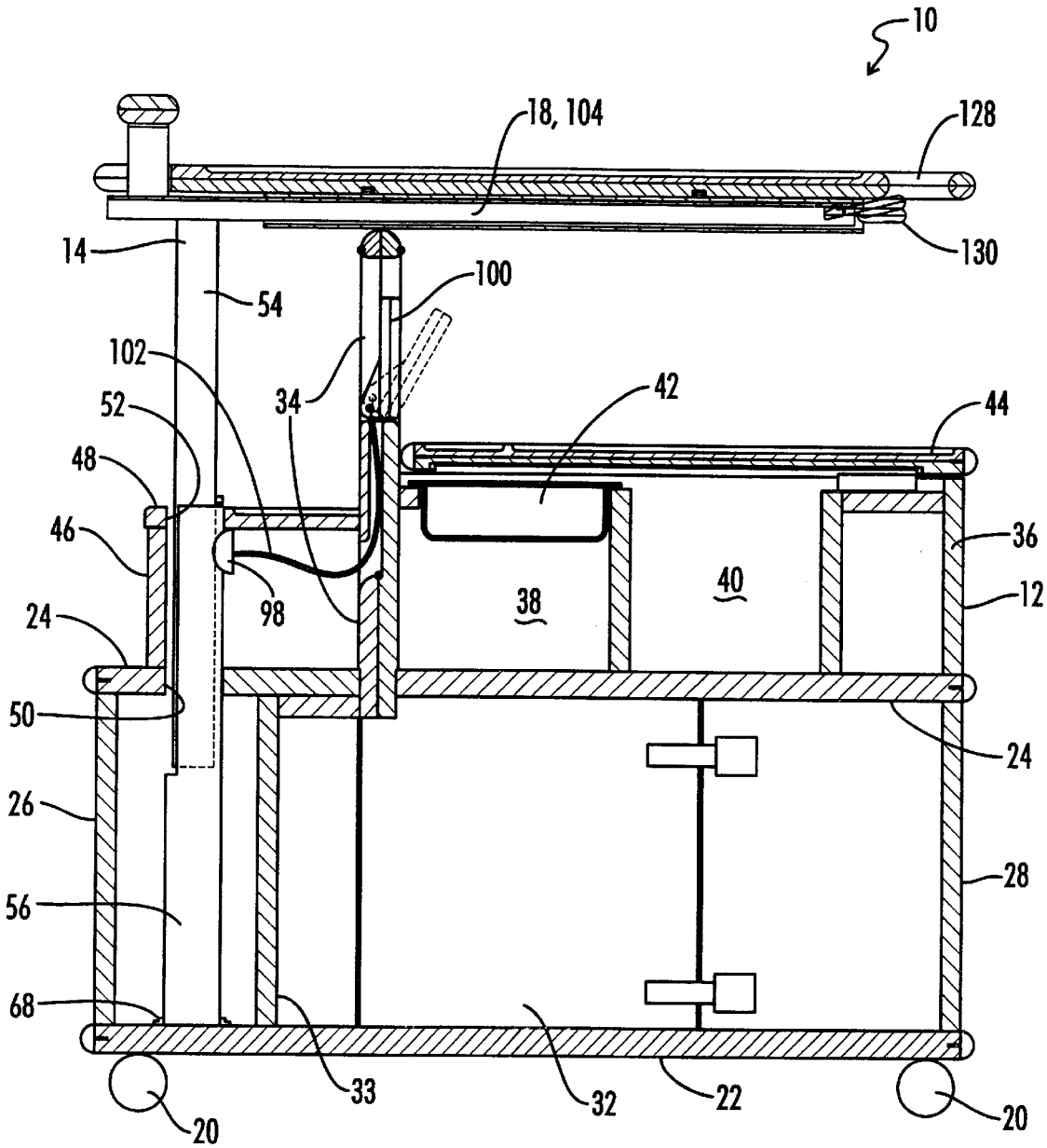
FIG. 4 is an elevation sectioned view of the apparatus of FIG. 1 taken along line 4—4 of the FIG. 3.
Figure 5:
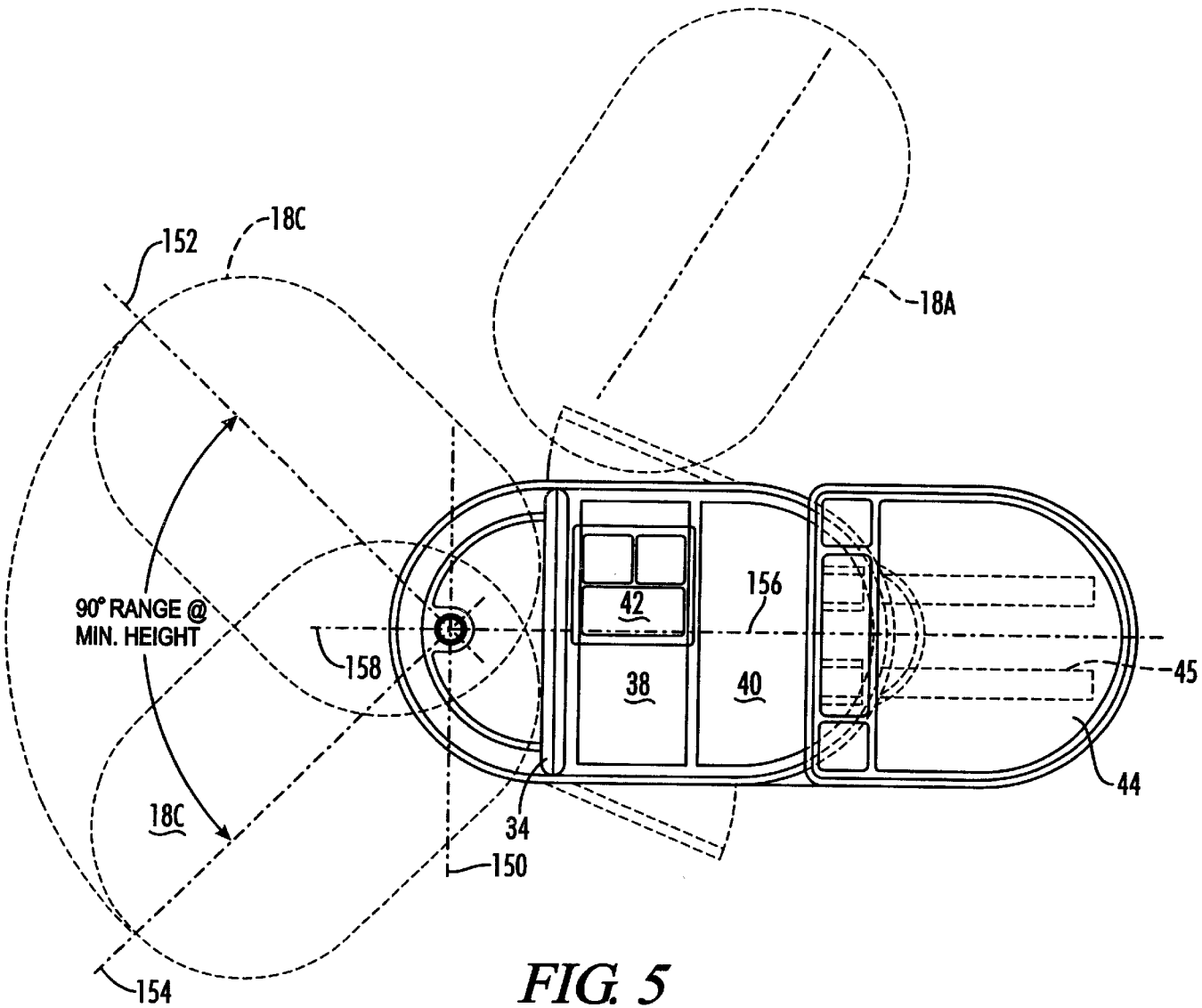
FIG. 5 is a top plan view of the apparatus of FIG. 1, showing a slidable auxiliary tray in its extended position and showing the various ranges of pivotal movement of the table top relative to the base.

As is best seen in FIG. 5, wherein the table 18 has been rotated so that it mostly extends outward away from the base 12, the base 12 has a base plan view shape which is substantially oval. As is also apparent in FIG. 5, the table 18 has a table plan view shape which is substantially oval, and which is substantially similar in size to the oval shaped base shape, so that when the table 18 is located immediately over the base 12 as shown in FIGS. 1, 2, 3 and 4, the table 18 is substantially superimposed over the base 12 in plan view.

As is best seen in FIG. 4, the base 12 is an enclosed cabinet which is supported on casters 20. The base 12 includes a bottom panel 22 and an intermediate panel 24 connected by curved end walls 26 and 28.

Intermediate the end walls 26 and 28, on opposite sides of base 12, are hinged doors 30 and 32 which provide access to the interior storage space defined in base 12 between panels 22 below and 24 above, between end walls 26 and 28.

An interior support wall 33 extends between the bottom panel 22 and intermediate panel 24.

A transom wall or bulkhead wall 34 extends upward from intermediate panel 24. When the table 18 is in its bedside position there is a very small clearance between table 18 and the top edge of bulkhead wall 34. Transom wall 34 extends across the width of base 12 as seen in FIG. 5.

The base 12 further includes a partially oval shaped upper wall 36 which defines interior storage areas 38 and 40 therein. As seen in FIG. 4, a removable bin 42 is received in storage compartment 38.

A slidable auxiliary tray 44 is mounted on top of the wall 36 and is slidable between a closed position as seen in FIGS. 1 and 4 wherein the auxiliary tray 44 covers the storage compartments 38 and 40, and an open position shown in FIG. 5 wherein the auxiliary tray 44 has been moved to uncover the storage compartments 38 and 40 to provide access thereto. The closed position of FIGS. 1 and 4 may be described as a retracted position wherein the auxiliary tray 44 overlies the base 12, and the open position of FIG. 5 may be described as an extended position wherein the auxiliary tray 44 overhangs the base 12.

The auxiliary tray 44 slides upon guide rails 45, or other conventional sliding mechanism.

The base 12 also includes a small semi-circular wall 46 covered by an upper panel 48.

As is best seen in FIG. 4, the intermediate panel 24 and upper panel 48 have openings 50 and 52, respectively, defined therein through which the column 14 extends.

A handle 37 extends outward from side wall 36 to aid in movement of the apparatus 10 upon the casters 20.

The bulkhead wall 34 has ergonomically shaped and oriented hand openings 53 defined therethrough. The openings 53 are slots set at an angle of approximately 45° and spaced apart to define handles 53 and 57 therebetween which can be easily grasped by a patient lying in a bed beside the apparatus 10.

The Adjustable Column Construction

The details of construction of the column 14 are best seen in FIGS. 6–9.

Figure 6:
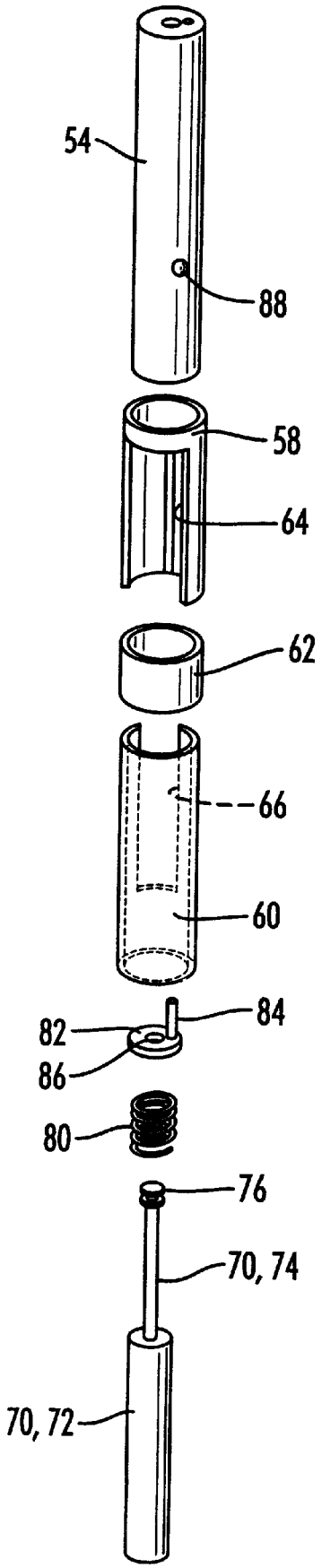
FIG. 6 is an exploded view of the adjustable column mechanism.

FIG. 6 is an exploded view of the internal components of the column 14. The column 14 includes a pivot cylinder 54 which extends upward out of a pivot base assembly 56.

The pivot base assembly 56 includes an upper pivot base 58 and a lower pivot base 60 which are connected by a collar 62. The upper pivot base 58 has a slot 64 defined therein, which as further described below, will define the range of pivotal motion permitted for the table 18 when the table 18 is elevated upward to its overbed position.

The lower pivot base 60 includes a slot 66 defined therein, which, as further described below, will define a second different range of allowable pivotal motion for the table 18 when the table 18 is lowered to a reading position.

As seen in FIG. 4, the pivot base assembly 56 is fixedly attached by a column mounting ring 68 to the bottom panel 22 of base 12.

Figure 7:
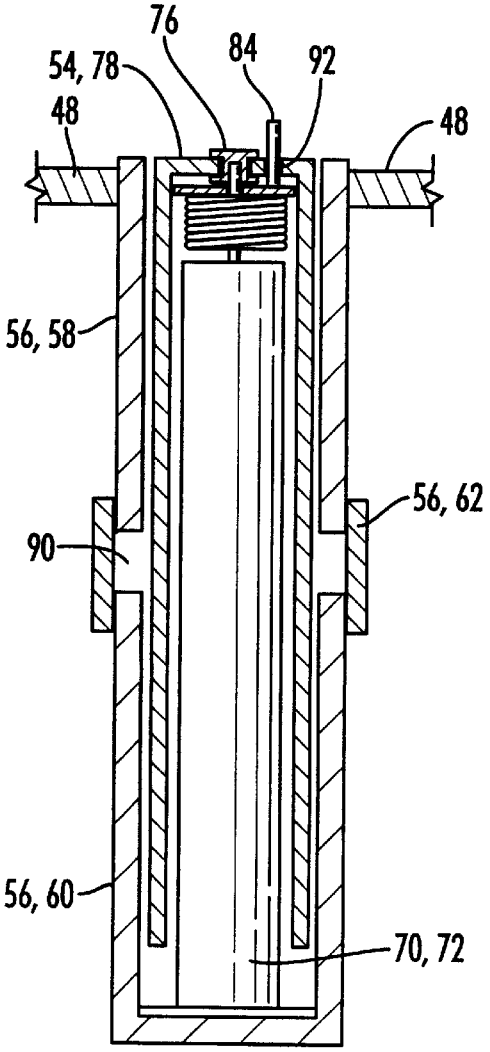
FIG. 7 is an assembled view of the adjustable column mechanism in its retracted position.
Figure 8:
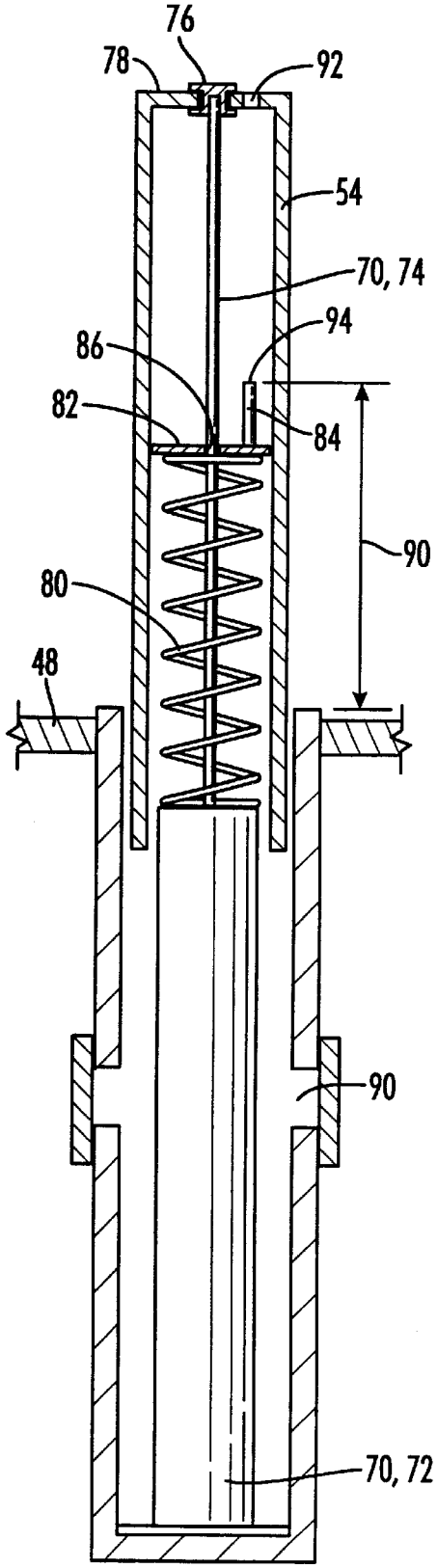
FIG. 8 is an assembled view of the adjustable column mechanism in its extended position.
Figure 9:
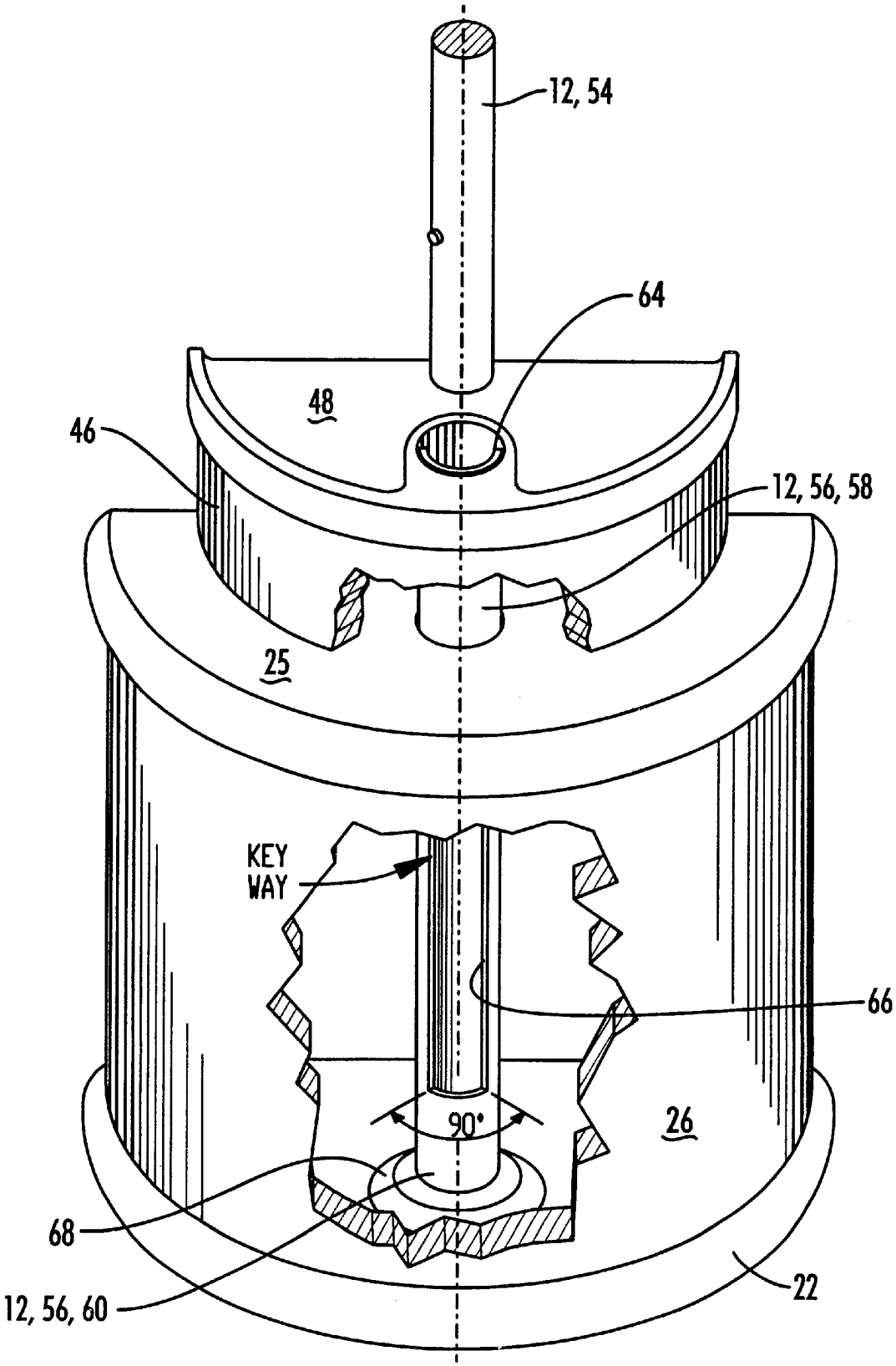
FIG. 9 is an isometric, partially cut away view of the base of the apparatus with certain components of the adjustable column mechanism being shown in exploded view.

Column 14 includes a gas strut 70 which has a strut cylinder 72 fixedly attached to the lower pivot base 60 and contained therein, as best seen in FIGS. 7 and 8. Gas strut 70 includes a strut rod 74 which extends from the strut cylinder 72. As will be understood by those skilled in the art, the gas strut 70 is filled with compressed gas which biases the rod 74 upward relative to cylinder 72 so as to aid in lifting or moving any apparatus attached to the rod 74, which in the present case is the table 18.

The strut rod 74 carries an annular connector ring 76 on its upper end which is received within and connected to the upper end 78 of pivot cylinder 54 as seen in FIGS. 7 and 8.

The pivot cylinder 54 is a hollow member which is telescopingly received within the upper and lower pivot bases 58 and 60, and which is telescopingly received about the gas strut cylinder 72.

Column 14 further includes an expansion spring 80 which sits on top of gas strut cylinder 72. A spring retainer disk 82 sets on top of expansion spring 80. An eccentrically positioned vertical lockpin 84 is attached to and extends upward from retainer disk 82. The retainer disk 82 has a central bore 86 defined therein through which the strut rod 74 extends. The pivot cylinder 54 includes a radially extending guide pin 88. The guide pin 88 extends radially outward into the space defined by slots 64 and 66.

As seen in FIGS. 7 and 8, when the upper and lower pivot bases 58 and 60 are assembled with the collar 62, there is an annular gap 90 defined therebetween.

The various positions of table 18 will be defined by travel of the guide pin 88 within the slot 64, the annular gap 90, and the slot 66. It will be appreciated that the annular gap 90 communicates the slots 64 and 66.

The upper end 78 of pivot cylinder 54 includes an eccentric hole 92 defined therein. As seen in FIG. 7, when the upper end 78 of pivot cylinder 54 is engaged with the spring retainer disk 82, the lockpin 84 extends upward through the opening 92. As further described below, the lockpin 84 extends into engagement with the table 18 and will prevent lateral extension of the table 18 when the table 18 is engaged with lockpin 84.

As will also be further described below, the expanding movement of expansion spring 80 will carry the retainer disk 82 upward for a portion of the upward travel of pivot cylinder 54. The upwardmost position of retainer disk 82 is shown in FIG. 8, wherein the upwardmost position of the upper end 94 of lockpin 84 is shown to be a distance 96 above the upper panel 48. As is further described below, the distance 96 through which the retainer disk 82 and lockpin 84 will travel corresponds to the height of the bulkhead wall 34 so that when the table 18 is elevated above the bulkhead wall 84, the table 18 will move out of engagement with lockpin 84 and thus, lateral movement of the table 18 will be allowed.

Correspondingly, when the table 18 is in its bedside position as illustrated in FIGS. 1–4, or when the table 18 is lowered from the bedside position to a reading position, as further described below, the lockpin 84 will be in engagement with the table 18 so as to prevent lateral sliding movement of the table 18. Thus, the lockpin 84 and associated structures may be described as a releasable locking mechanism 84 for preventing lateral sliding motion of table 18 until the table 18 is elevated beyond a predetermined elevation, at which point the table 18 moves out of engagement with lockpin 84.

As shown in FIG. 4, a column locking mechanism 98 of conventional design releasably locks the pivot cylinder 54 in position relative to the pivot base assembly 56. A release paddle or release handle 100 is mounted within the bulkhead wall 34 and is connected to release mechanism 98 through a cable connector 102. In FIG. 4, the release paddle 100 is shown in solid lines in its locked position, and in dashed lines in its released position.

The cable connector 102 is of a conventional bicycle cable type which has a actuating wire which slides within an external sheath upon movement of releasing handle 100. The sliding wire will actuate calipers or other type of latching mechanism 98. The entire mechanism including the handle 100 will be spring biased toward its latched position.

Thus, when a patient lying in the bed adjacent the apparatus 10 wishes to adjust the height or pivotal orientation of the table 18 relative to the base 12, they simply pull on the releasing paddle 100 to release the locking mechanism 98, thus allowing the pivot cylinder 54 to easily extend or retract and to pivot relative to the pivot base assembly 56.

The bulkhead wall 34 serves several functions. First, it provides a place to mount the release handle 100. Second, it includes the ergonomic hand grips 56 and 57. Third, it indicates the downward limit of movement of table 18 when the table 18 is in its bedside position thus allowing articles to be stored on top of the auxiliary tray 44 at all times without concern for interference of those articles with motion of the table 18.

The Table Mounting System

Figure 11:
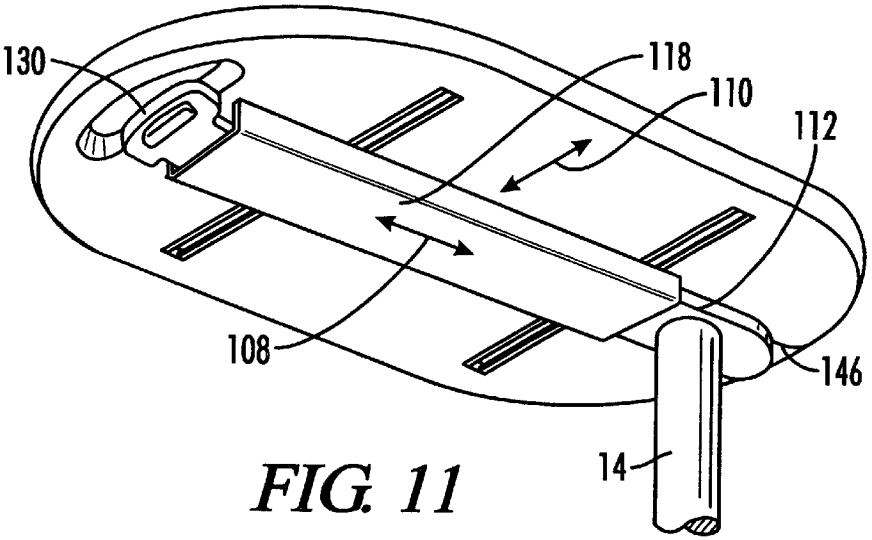
FIG. 11 is a isometric view of the apparatus of FIG. 10 taken from beneath the table.
Figure 10:
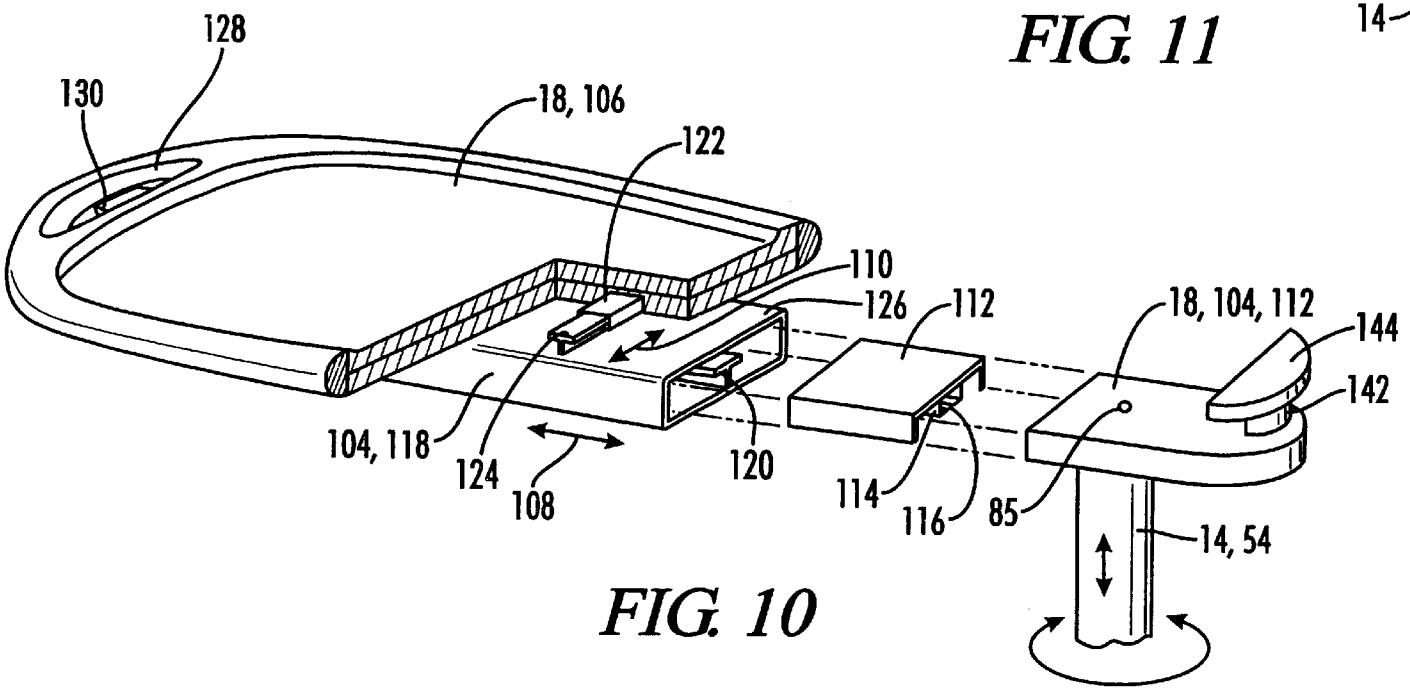
FIG. 10 is an isometric, partially cut away view of the table, taken from above, illustrating the mechanism which permits lateral position adjustment of the table.

The mounting of the table 18 upon the column 14 is best shown in FIGS. 10 and 11. The table 18 includes a table support frame 104 attached to the column 14, and a table top tray 106 slidably mounted on the table support frame 104 so that the table top tray 106 can slide laterally along two perpendicular axes 108 and 110 relative to the table support frame 104.

The table support frame 104 includes a pivot arm 112. In FIG. 10, a portion of the pivot arm 112 has been cut away to reveal the internal construction thereof.

The pivot arm 112 is shaped in cross-section like a downwardly open channel, and it has a slide track 114 mounted on the central portion thereof. The slide track 114 is also shaped like a downwardly open channel and it has an open slot 116 defined in the bottom thereof.

The table support frame 104 also includes a tray channel 118 which is best shown in FIG. 11 as telescopingly slidingly received over the pivot arm 112. The tray channel 118 includes a first guide rail 120 which is T-shaped in cross-section and which has an upper crossbar of the T received within the slide track 114 with the vertical member of the T extending through the slot 116.

The table top tray 106 has a second slide track 122 formed therein which is received about a second guide rail 124 which is attached to the top surface 126 of tray channel 118. The second guide rail 124 is oriented at 90° to the first guide rail 120, so that the first guide rail 120 defines the first sliding axis 108 and the second guide rail 124 defined the second sliding axis or sliding direction 110. There is a third guide rail 123 (See FIG. 3) oriented parallel to second guide rail 124 and constructed similar thereto.

Alternatively, the T-shape rails and slide tracks may be replaced with conventional drawer slides.

Figure 12:
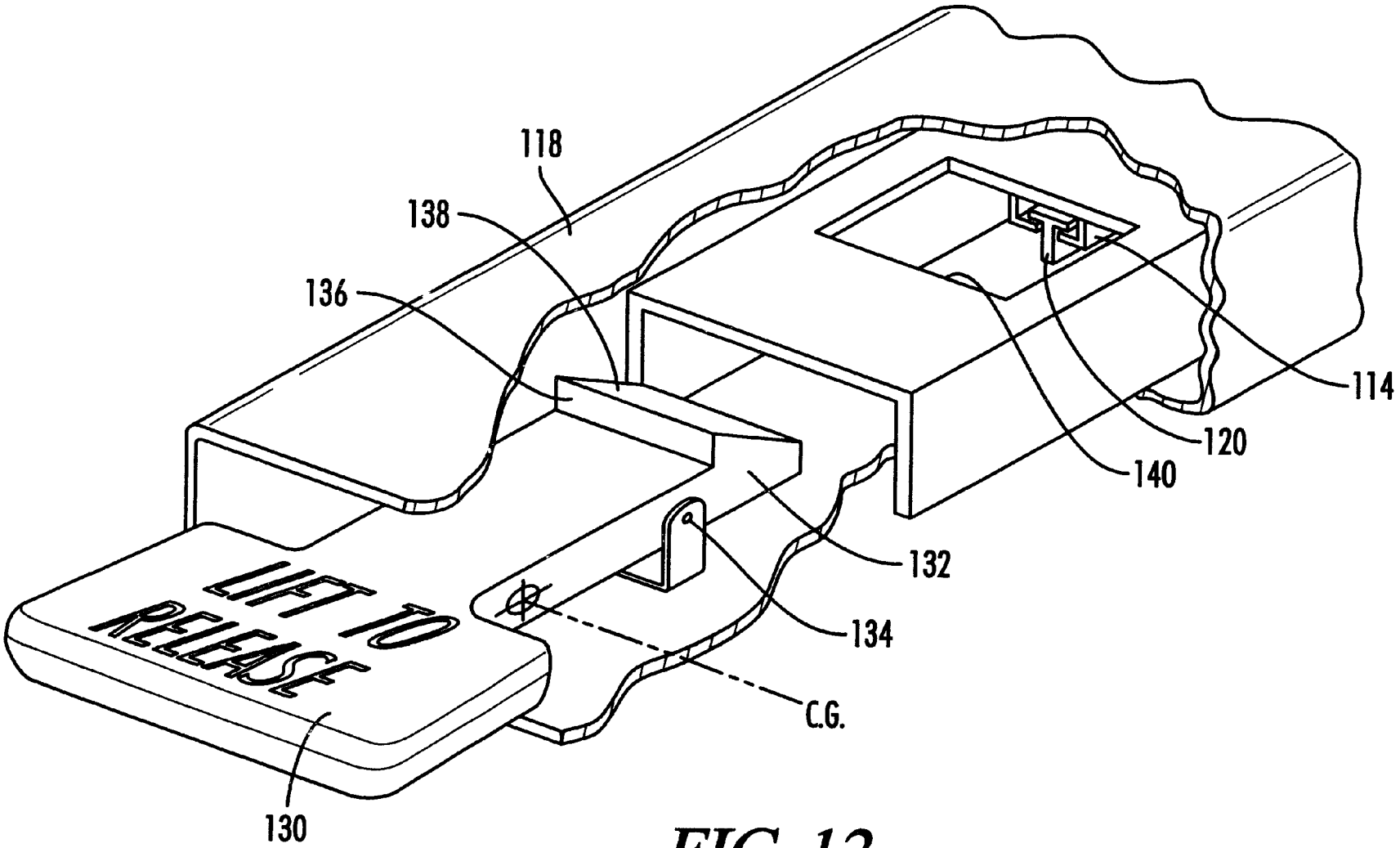
FIG. 12 is an isometric, cut away view of the releasable locking mechanism associated with the table top.

The table top tray 106 includes an opening 128 near its outer end through which a patient lying in a bed can easily insert their hand to access a release handle 130 associated with the table top tray 106. The details of construction of a releasing mechanism 132 associated with lateral movement of the table top tray 106 is best shown in FIG. 12.

The release handle 130 is attached to a releasing arm 132 which is pivotally mounted on pivot point 134 within the tray channel 118. Releasing arm 132 has an upward protruding latching shoulder 136 and a tapered guide surface 138 defined thereon.

When the tray channel 118 is in a fully retracted position having the pivot arm 112 received therein as shown in FIG. 11, the latching shoulder 136 is received within a square latch opening 140 defined in the tray channel 118. The latching end of releasing arm 132 is biased upwardly by gravity due to the weight of handle 130 which pivots about pin 134.

Thus, when the tray 106 is slid inward to its fully retracted position, the latch arm 132 will snap upward so that its latching shoulder 136 is received within the latch opening 140, thus locking the table top tray 106 against sliding movement in direction 108. To release the table top tray 106, one must merely lift upward on handle 130 which will pivot the shoulder 136 downwardly thus releasing the latching shoulder 136 from latch opening 140 and allowing the tray 106 to slide outwardly in direction 108.

As seen in FIG. 10, the pivot arm 112 has a small post 142 located near one end thereof and has a hand grip 144 attached to the upper end of post 142.

The table top tray 106 has a slot 146 (See FIG. 3) extending a short distance into its proximal end, and when the table top tray 106 is fully retracted, the post 142 is received within the slot 146. This engagement of post 142 with slot 146 will prevent lateral movement of table top tray 106 along axis 110 when the table top tray 106 is in its fully retracted position with the locking arm 132 locking the table top tray 106 in that fully retracted position along direction 108. Thus, when table top tray 106 is in its fully retracted position as shown in FIG. 11, it is locked against lateral motion in either direction 108 or direction 110.

The second slide track 122 and second guide rail 124 have a spring loaded detent mechanism which provides a positive indication that the table top tray 106 is centrally located upon the tray channel 118. Once post 142 is disengaged from slot 146, the tray 106 can be moved by pushing with sufficient force in either direction along axis 110. The spring loaded detent will release thus allowing the table top tray 106 to be moved in direction 110 as desired.

The Support Structure

As shown in FIGS. 13 through 22, yet another preferred embodiment of the present invention further improves the combination table apparatus 10 through the use of a base support structure 200 and outrigger support 202 attached to the base 12. This embodiment allows for the apparatus 10 to be moveably positionable on a floor and also provides increased lateral support for the apparatus 10.

Figure 14:
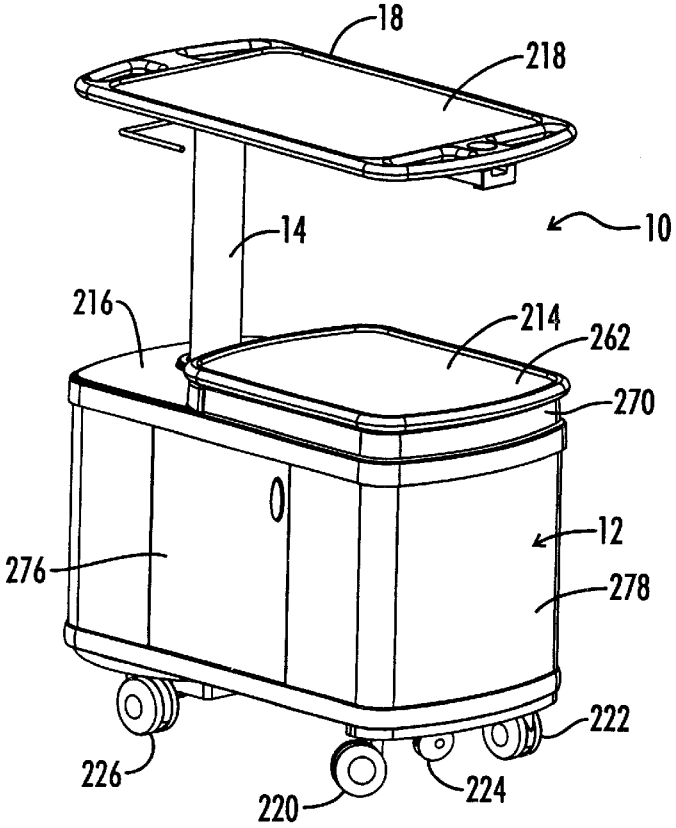
FIG. 14 is an elevated side view of the combination table with support structure and outrigger support.
Figure 15:
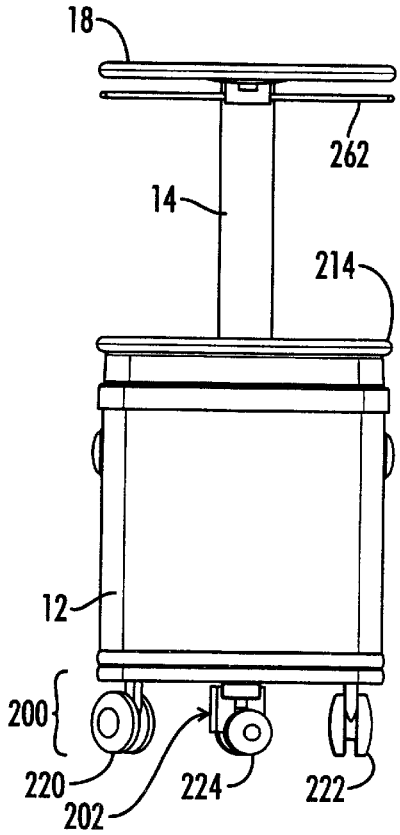
FIG. 15 is an end view of the combination table including a support structure and outrigger support attached to the base.

The combination bedside and overbed table apparatus 10 includes a table 18 supported on a rotating column 14. The table 18 is rotationally fixed to the column 14 so the table 18 and the column 14 rotate as a single unit. FIGS. 14 and 15 illustrate the table 18 including a cantilever section 218 which extends outward from the rotating column 14. This allows for the table 18 to be moved or rotated between a bedside position and an over bed position. This combination table apparatus 10 also includes a base 12 that defines a first base end 214 and a second base end 216 for the base 12. When the table 18 is in the bedside position, the cantilever section 218 is located directly over the first base end 214 of the base 12 as shown in FIGS. 14 and 15. When the table 18 is placed in the overbed position shown in FIGS. 17 and 18, the cantilever section 218 of the table 18 is rotated by the column 14 mounted in the second base end 216 to overhang the base 12 so that the table 18 may be used over a bed while the base 12 is positioned beside the bed.

Figure 16:
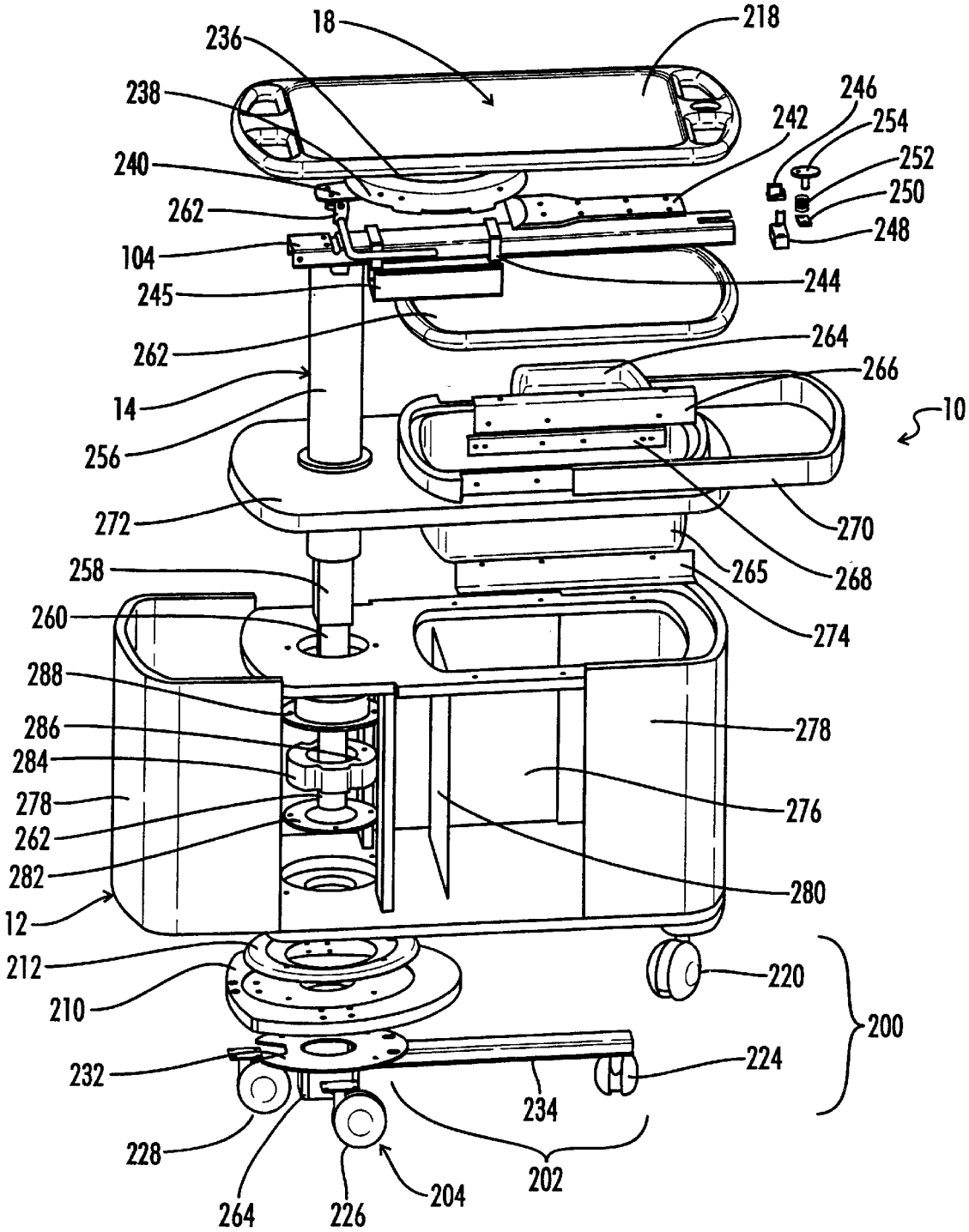
FIG. 16 is an exploded view of the combination table including the support structure outrigger support.
Figure 17:
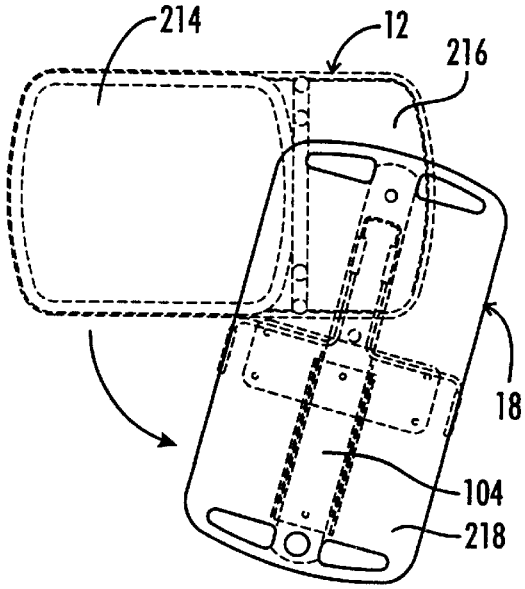
FIG. 17 is a top view of the combination table with the table rotated to extend past the base.
Figure 18:
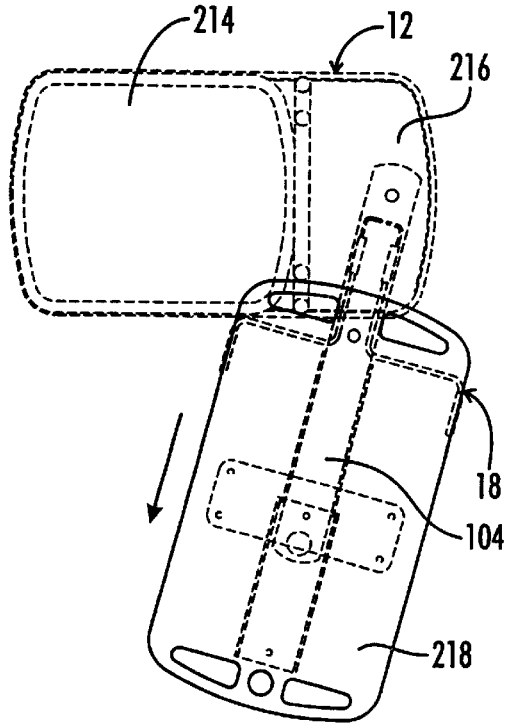
FIG. 18 top view of the combination table with the table rotated and extended on an arm to further extend past the base.
Figure 19:
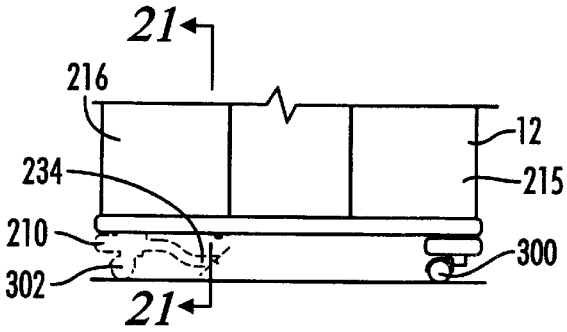
FIG. 19 is a side view of a support structure and outrigger support attached to the base.
Figure 20:
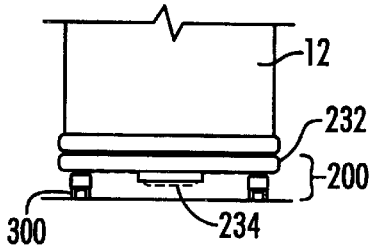
FIG. 20 is a front view of the combination table with support structure and outrigger support.
Figure 22:
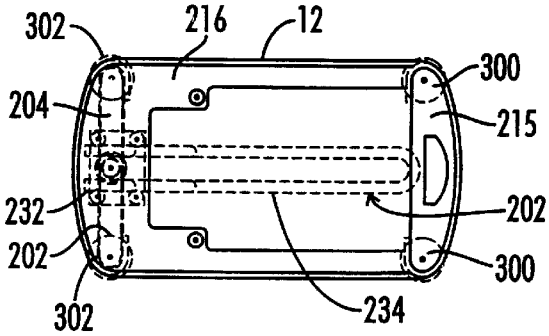
FIG. 22 is a bottom view of a support structure and bar-type outrigger support attached to the base.
Figure 21:
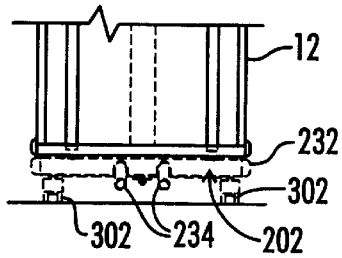
FIG. 21 is a cut away view of the combination table including a support structure and outrigger support attached to the base along line C—C of FIG. 19.

FIG. 16 shows the exploded view of the mounting of the table 18 on the column 14. The table 18 is mounted to a table bearing 236 attached to a turn disc 238. The table bearing 236 and turn disc 238 allow for the table 18 to be rotated in relation to the table support frame 104. The table support frame 104 is attached to the column 14. In this manner, the table 18 may be positioned both by rotating the column 14 in relation to the base 12, and by rotating the table 18 in relation to the table support frame 104.

The turn disc 238 is mounted on a plate cap 240 connected to a slide 242 mounted on an arm bearing 244 inside a cap bracket 245. The arm bearing 244 rides along the table support frame 104 to provide a slidable connection from the turn disc 238 to the table support frame 104. This connection allows for the turn disc 238, and the attached table 18, to be slideably extended and retracted along the table support frame 104 to increase and decrease the extension of the table 18 from the column 14. Thus, this additional movement allows the table 18 to be positioned by the rotation of the column 14 in relation to the base 12, the rotation of the table 18 in relation to the table support frame 104, and the extension of the table 18 from the column 14 along the table support frame 104. An extension lock 246 is constructed from cap stop 248 connected to a lock ramp 250, with a cap spring 252, for biasing a cap button 254. The extension lock is connected to the table support frame 104 to act as a stop and control the extension of the table 18 from the column 14.

The column 14 extends upward from the base 12 and is rotatably attached to the base 12. The column 14 includes an outer aesthetic sleeve or covering 256, upper extension member 258, and lower extension member 260 that house a gas strut 70 as previously described. The gas strut 70 operation may be connected to and controlled by a strut handle 262. The outer aesthetic sleeve 256 is connected to vertically move with the table support frame 104 so that the outer aesthetic sleeve 256 provides a clean look to the column 14 in both the retracted and extended positions. The upper extension member 258 of the column 14 is slideably mounted on the lower extension member 260 to allow for the vertical movement of the table 18 similar to the vertical movement previously described. The upper extension member 258 is also rotationally fixed to the table support frame 104 so that the rotation of the table 18 and the table support frame 104 rotates the upper extension member 258. The lower extension member 260 is then rotationally fixed to the upper extension member 258. However, this embodiment differs in the support of the column 14 and the attachment of the column 14 to the base 12. In this embodiment, the lower extension member 260 of the column 14 passes through the base 12 and is rotationally fixed to the caster assembly 232. The caster assembly 232 supports the weight of the column 14 and allows for the column 14 to be rotated in relation to the base 12. The square connection of the square end 262 of the lower extension member 260 and the square receiving aperture 264 of the caster assembly 232 shown in FIG. 16 rotationally fixes the column 14 to support arm 234 of the caster assembly 232. Thus, the table 18 is rotationally fixed through the column 14 to the support arm 234. In this manner, the rotational extension of the support arm 234 from the base 12 is controlled by the rotational movement of the table 18.

The base 12 houses some additional support structure for the column 14. This additional structure includes a striker plate 282 for use in connection with a column clamp 284. The striker plate 282 is fixed in position on the base 12. The column clamp 284 is then rotationally fixed to the column 14. The column clamp 284 includes a lock assembly 286 which may be extended to pass through an opening in the striker plate 282, much like a simple door lock extends into a striker plate on a door jamb. In this manner, the lock assembly 286 rotationally fixes the column clamp 284 to the striker plate 282 and thereby locks the column 14 to the base 12 in a non rotating position. The lock assembly 286 may then be retracted to allow for rotation of the column 14 in relation to the base 12. Also shown in FIG. 16 is the use of a rotational bearing 288 for supporting the column 14 in the base 12.

The base 12 further includes a tray top 262 adapted to cover a tray pan 264 and bin 265 mounted in the base 12.

The tray top 262 is mounted on a rail support bracket 266 and attached to slides 268 for a slideably connection to the bin cover 274. This allows the tray top 262 to be moved between a cover position and an extended position for selectively covering the tray bin 264. A wood guard skirt 270 is attached to the tray top 262 to aesthetically cover the rail support bracket 266 and attached slides 268. The bin cover 272 also includes tray angle brackets 274 for supporting the bin 265. The base side panels 276 and base end panels 278 of the base 12 cover the base sides and ends respectively. One base side panel 276 has been removed and one base end panel 278 moved for illustrative purposes in FIG. 16 to show the internal plate divider 280 which provides internal support to the base 12.

As described in the previous embodiment, by mounting standard casters 20 at the corners of the base 12, a stable combination table apparatus 10 is provided. When the table 18 is in the bedside position, the cantilever section 218 is located directly over the base 12 and the center of gravity of the combination table 18 apparatus 10 is located within the area of the base 12. However, when the table 18 is placed in the overbed position, the cantilever section 218 of the table 18 overhangs the base 12 so that the table 18 may be used over a bed while the base 12 is positioned beside the bed. This positioning of the cantilever section 218 of the table 18, in addition to any weight or force placed on the cantilever section 218, operates to shift the center of gravity of the combination table apparatus 10. If the center of gravity is moved past the casters 20 located on the corners of a standard base 12, then the unit will become unstable 18 and may tilt or fall over. Because people in hospitals may need to rely on furniture for support, this instability is not desirable. This may be countered by the addition of weight to the base. However, the mere addition of weight to the base 12 to counteract the cantilever action of the table 18 may make the table 18 very heavy and difficult to move which is also undesirable. Therefore, an improved support structure 200 has been provided that is attached to the base 12 and adapted to support the base 12 on the floor.

The improved support structure 200 includes an outrigger support 202, also known as an outrigger assembly 202, that provides a corresponding lateral support to the base 12 when the cantilever section 218 overhangs the base 12. The outrigger assembly 202 is supportively connected to the base plate 210 and adapted to extend past the base 12 during rotation of the base plate 210. This outrigger support 202 is also attached to the table 18 and to the base 12 so that the movement of the table 18 from the bedside position to the overbed position generates a related movement or extension of the outrigger support 202. In this manner, the outrigger support 202 is adapted to provide a corresponding lateral support to the base 12 when the cantilever section 218 overhangs the base 12.

For the preferred embodiment, the outrigger support 202 is rotationally attached to the base 12. While other methods or machinery, such as telescoping arms, may be provided for extending the lateral support, the preferred embodiment of the present invention uses a rotational movement of the outrigger support 202 to extend past the base 12. This embodiment provides the simplest control mechanism for extending the outrigger support 202 in response to the movement of the table 18.

The outrigger support 202 includes a lateral extension member 234 that is adapted to extend past the base 12 when the cantilever section 218 overhangs the base 12. The outrigger support 202 may operate as a non-floor contacting arm that does not support the table 18 until the table 18 begins to overturn, or may include a floor contact member 215, shown as third caster 224, to provide constant support to the base 12. For mobility, the floor contact member 215 is preferably constructed as a caster 20.

As noted by the exploded view of FIG. 16, the apparatus 10 is supported on multiple casters 20. A total of six casters 20 are used to support the base 12, including the first caster 220, second caster 222, third caster 224, fourth caster 226, fifth caster 228, and sixth caster 230. The first caster 220 and second caster 222 are mounted at each of the corners of the first end 215 of the base 12. These two casters 220, 222 support the first end of the base 12 on the floor and provide a limited amount of lateral support to the base 12. However, these casters 220, 222 are limited in their support because of their fixed positioning on the base 12.

To improve the stability of the base 12, an additional four casters 20 are used to support the second end 216 of the base 12 including the third caster 224, fourth caster 226, fifth caster 228, and sixth caster 230 which are mounted to a caster assembly 232. The caster assembly 232 is connected through a rotational support plate 210 to a bearing 212. The bearing 212 is then connected to the base 12. The bearing 212 allows for the caster assembly 232 and the attached casters 224, 226, 228, 230 to rotate in relation to the base 12.

The caster assembly 232 includes a first outrigger support 202 including a support arm 234 to connect the third caster 224 to the caster assembly 232. In this manner, the third caster 224 can rotate at an extended radius to extend beyond the sides of the base 12 and to provide a rolling engagement between the floor and the support arm. This allows for the support arm 234 and third caster 224 to provide an increased amount of lateral support to the base 12 when the table 18 is extended from the base 12.

The fourth caster 226, fifth caster 228, and sixth caster 230 are shown directly attached to the caster assembly 232. In this manner, the caster assembly 232 acts like a shorter, one-half base width, version of the support arm 234 to position each of the fourth, fifth, and sixth casters 226, 228, 230 in relation to the base 12. As noted by the rotated position of the caster assembly 232 shown in FIG. 13*a*, the fourth caster 228 is positioned opposite from the third caster on the caster assembly 232 to form a second outrigger support 204. This opposite positioning of the fourth caster 228 allows the fourth caster 228 to rotate with the caster assembly 232 in relation to the base 12 and to provide an opposing lateral support from the third caster 224 when the table 18 overhangs the side of the base 12. Thus, both sides of the base 12 are supported when the support arm 234 extends past the side of the base 12. This allows for support for the cantilever positioning of the table 18 above the base 12 while still providing lateral support to both the cantilever side and non-cantilever side of the base 12.

Figure 13:
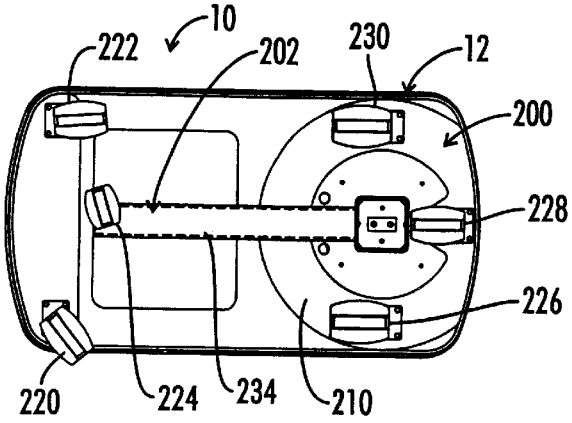
FIG. 13 is a bottom view of a support structure and outrigger support attached to the base.
Figure 13A:
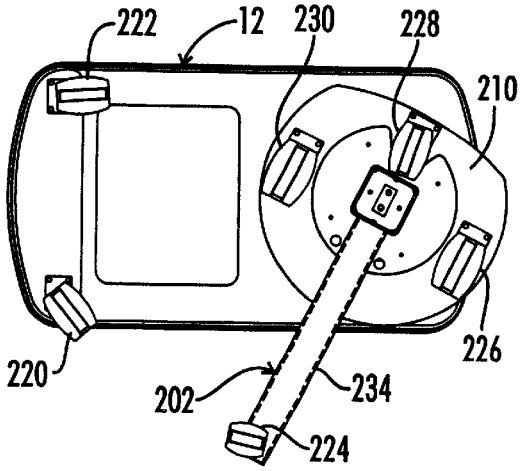
FIG. 13*a* is a bottom view of a support structure showing the outrigger support rotated in relation to the base.

When the third caster 224 and fourth caster 228 are positioned on directly opposite sides of the caster assembly 232 as shown in FIG. 13, and the support arm 234 is positioned under the base 12, additional side support for the base 12 may be desired. This additional support is provided by the fifth caster 226 in a third outrigger support 206 and sixth caster 230 in a fourth outrigger support 208. As shown in FIG. 13, a third outrigger support 206, including the fifth caster 228, is positioned to provide a lateral support to the base 12 when the support arm is located under the base corresponding to the positioning of the table 18 over the base 12. The fourth outrigger support 208, including the sixth caster 230, is then mounted on the caster assembly 232 directly opposite the fifth caster 226 so that the sixth caster 230 will provide an opposing lateral support to the base 12 when the table 18 is located over the base 12. In this manner, the fifth caster 226 and sixth caster 230 act like the first caster 220 and second caster 222 on the first end 215 of the base 12, so that the fifth caster 226 and sixth caster 230 support the corners of the second end 216 of the base 12 when the support arm 234 is located under the base 12. While the fifth and sixth caster 226, 230 could be directly mounted to the base, they would limit the rotational movement of the support arm. In order to allow for the support arm 234 to extend past the base 12 as far as possible, and to allow for an associated maximum extension of the table 18 over the base 12, the fifth and sixth casters 226, 230 are mounted as a third outrigger support 206, and fourth outrigger support 208 to the caster assembly 232 so that they rotate with the support arm 234. This allows for the support structure 200 to use multiple casters 20 attached as outrigger supports 202, 204, 206, 208 to allow for a full 360 degree rotation of the support arm 234.

FIGS. 19 through 22 show how a caster assembly 232 may be used with only four casters 20 to show how the number of casters 20 may be changed for offering different types of outrigger supports 202. For this embodiment, a total of four casters 20 are used to support the base 12, including two fixed casters 300 and two rotational casters 302. The two fixed casters 300 are mounted at each of the corners of the first end 215 of the base 12. These fixed casters 300 support the first end 215 of the base 12 on the floor and provide a limited amount of lateral support to the base 12.

An additional two rotating casters 302 are attached on a caster assembly 232 at the second end 216 of the base. The caster assembly 232 is also connected through a support plate 210 to a bearing (not shown). This embodiment of the caster assembly 232 includes a support arm 234 without a caster 20 and with or without a floor contact member 215. In this manner, the support arm 234 may slide along the floor or may be positioned slightly above the floor so that the support arm 234 will only contact the floor when the base 12 begins to tip over. The support arm 234 may still rotate at an extended radius to extend beyond the sides of the base 12 and provide an engagement with the floor to support the base 12. Thus, the support arm 234 can provide an increased lateral support to the base 12 when the table 18 is extended from the base 12.

The two rotating casters 302 are positioned to provide an opposing lateral support from the support arm 234 when the table 18 overhangs the side of the base 12, and to provide the lateral support for the base 12 when the support arm 234 is underneath the base 12. Thus, both sides of the base 12 are supported when the support arm 234 is not extended past the side of the base 12. The fixed casters 302 are mounted to the caster assembly 232 so that they rotate with the support arm 234. This allows for the support structure 200 to use the rotating casters 302 attached as outrigger supports 202 to allow for a full 360 degree rotation of the support arm 234.

As shown in FIGS. 13 through 22, the preferred embodiment of the table 18 and outrigger supports 202 are adapted to be allow a full 360° rotational positioning of both the table 18 and outrigger supports 202. In contrast, a single outrigger support 202 such as a support arm 234 could be attached to the base 12 with fixed casters 20 at each of the corners of the base 12. This construction will only allow for partial rotational movement of the single outrigger support 202 because the casters 20 on outrigger support mounting end 216, described as the second base end 216, will interfere with the rotation of the outrigger support 202. In order to allow for the an outrigger support 202 to extend past the base 12 as far as possible, and to allow for an associated maximum extension of the table 18 over the base 12, the preferred embodiment utilizes the support structure 200 which has multiple outrigger supports 202 rotationally attached to the base 12 to allow for a full 360 degree rotation to allow the extension of at least one outrigger support 202 past the side of the base 12 to provide the lateral support for the cantilever positioning of the table 18.

Operation of the Overbed Table

The manner of operation of the overbed table is best described with reference to FIGS. 1 and 5. In FIG. 1, the table 18 is shown in what may be described as a bedside position in solid lines wherein the table 18 directly overlies the base 12 and is supported by the column 14. When the table 18 is in the bedside position illustrated in solid lines in FIG. 1, the guide pin 88 of pivot cylinder 54 is received in the annular gap 90 between upper and lower pivot bases 58 and 60, so that upon release of the releasing mechanism 98, the table 18 can rotate through an entire 360° arc about axis 16. As further described below, rotation of the table 18 through 180° from the position shown in solid lines of FIG. 1 will move the table to a rearward extending position where it can then move down into a lower elevation range corresponding to a reading chair position of the table.

It is also noted that when the table 18 is in its bedside position illustrated in solid lines in FIG. 1, the lock pin 84 extends through a hole 85 (See FIG. 10) of pivot arm 112 into a locking recess (not shown) in the lower surface of tray 106. This prevents lateral motion of tray 106 until the table 18 is raised above bulkhead wall 34.

Figure 2:
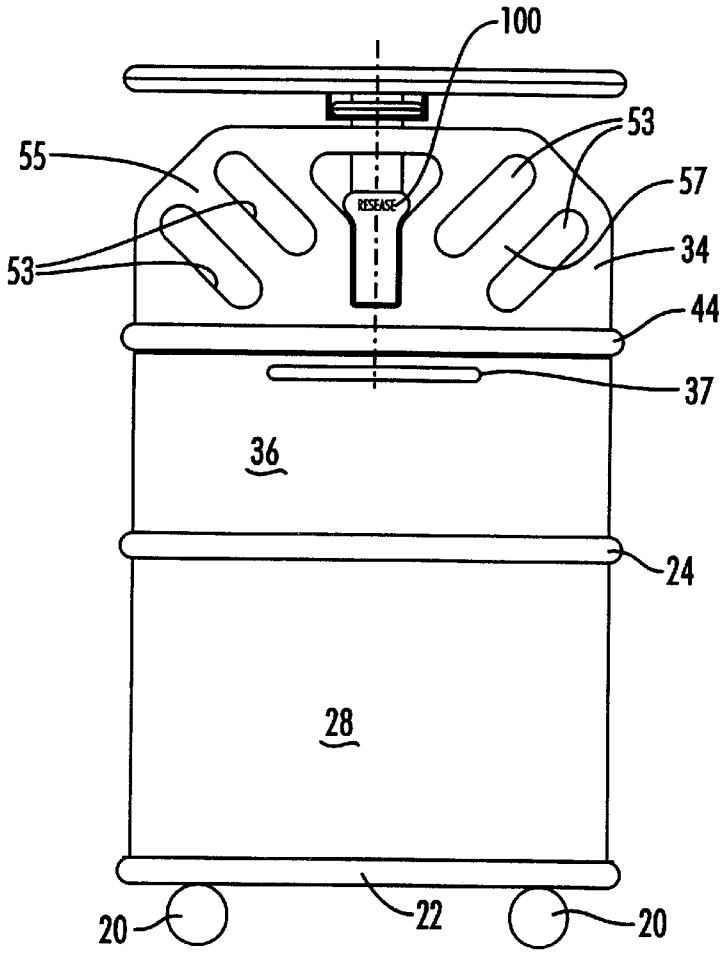
FIG. 2 is a front elevation view of the apparatus of FIG. 1.
Figure 3:
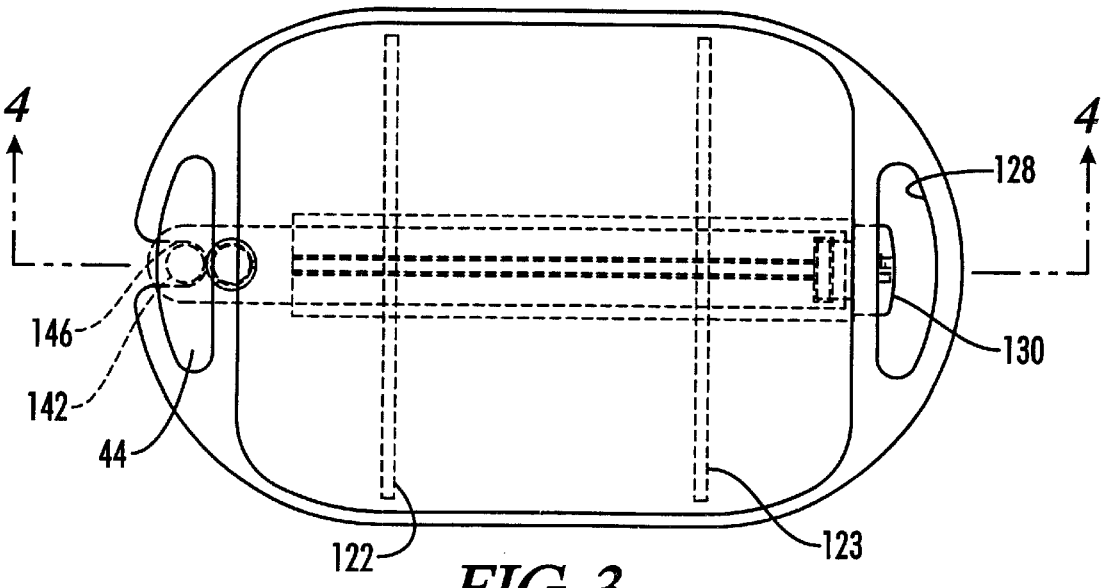
FIG. 3 is a top plan view of the apparatus of FIG. 1.

With the table 18 in the overbed position illustrated in solid lines in FIG. 1, and as illustrated in FIGS. 2, 3 and 4, the apparatus 10 may be rolled to a position adjacent the side of a bed and the table 18 may be used as a conventional bedside table. Additionally, various articles can be stored on top of the auxiliary tray 44, and various articles can be stored within and accessed from the internal storage compartments 38 and 40 by sliding the auxiliary tray 44.

When it is desired to move the table 18 to an overbed position, the patient or a person assisting the patient simply pulls the release handle 100 to release the releasable locking mechanism 98. Then, a slight upward force may be exerted on the table 18 to lift it to an elevated position as shown in dashed lines and designated as 18A in FIG. 1. As the table 18 is lifted, the guide pin 88 will be sliding upward within the slot 64 of upper pivot base 58. Also, the tray 18 may be pivoted about axis 16 through an angle of 180° as permitted by the construction of slot 64 which extends 180° about the upper pivot base 58.

In the plan view of FIG. 5, this 180° permissible rotational movement of table 18 extends from a line 148 to a line 150, so that the table 118 may overhang to either side of the base 12.

Also, as the table 18 is raised above the bulkhead wall 34, the table 18 is elevated upward out of engagement with pin 84. The table 18 is then free to be moved laterally along axes 108 and/or 110 upon release of the latching mechanism 132 by means of engaging release handle 130. Thus, for example, the table 18 may be moved elevationally to a position such is shown in 18A in FIG. 1, and may then be pivoted and laterally extended to the position shown in dashed lines as 18A in FIG. 5. The position shown in dashed lines as 18A in FIG. 5 and FIG. 1 illustrates one overbed position of the table 18. In the overbed position, the base 12 will still be sitting in position adjacent the side of the bed and will not necessarily have moved at all from its bedside position.

When the table 18 is in one of its overbed positions 18A, it can be laterally moved along the axes 108 and 110 to further position it at the most desired position relative to the patient.

As previously noted, the apparatus 10 also includes a third general position known as an "reading" position. To move the table 18 to a reading position wherein it can be utilized as a reading table over a chair or other seat located within the hospital room, reference is again made to FIGS. 1 and 5. Assuming that the table 18 begins in its standard bedside position as shown in solid lines in FIG. 1, the table 18 can be moved to a reading position by first rotating the table 18 through an angle of approximately 180°. The guide pin 88 will be rotating through the annular gap 90. Then, the table 18 can be lowered, with the guide pin 88 moving downward through the slot 66 of lower pivot base 60 to a lower reading position as shown in dashed lines and designated as 18C in FIG. 1 and corresponding to the solid line position and dashed line positions indicated as 18C in FIG. 5.

With the table 18 in its reading position, it extends generally rearward of the base 12 as shown in FIG. 5 and it can be pivoted through an arc of approximately 90° between a line 152 and a line 154 as defined by the angular dimensions of slots 66 which allows 90° of movement of guide pin 88. It is noted that when the table 18 is in one of the lower reading positions, the lockpin 84 extends through opening 92 into locking engagement with table top 18 to prevent lateral motion of table top 18, so that when the table top 18 is in the reading position it cannot be laterally extended, but can merely pivot about axis 16.

The allowable motion of the table 18 from its bedside position shown in solid lines in FIG. 1 to any of its elevated overbed positions as illustrated in dashed lines as 18A in FIGS. 1 and 5 may be described as an upper range of motion which includes an upper vertical range extending from the solid line position of tray 18 in FIG. 1 to the uppermost position permitted by the construction of column 14, and includes an upper pivotal range between lines 148 and 150 defined by the construction of slots 64 and upper pivot base 58.

Those positions of the table 18 from the bedside position shown in solid lines of FIG. 1, to the various lower reading positions as represented by 18*c* can be described as a lower range of motion including a lower vertical range extending from the elevation shown in solid lines in FIG. 1 down to the lowermost elevation shown in dashed lines in FIG. 18C, in FIG. 1, and a lower pivotal range defined between lines 152 and 154 (See FIG. 5) as defined by the construction of slot 66 in lower pivot base 60.

It is noted that the upper pivotal range between lines 148 and 150 on the right hand side thereof in FIG. 5 is at least partially non-coincident with, and in the illustration given, is completely non-coincident with the lower pivotal range defined between lines 152 and 154.

It will be appreciated that these pivotal ranges can be modified by changing the angles encompassed by the slots 64 and 66 in the upper and lower pivot bases 58 and 60, respectively.

It is also apparent in viewing FIG. 5 that a median line 156 of the upper pivotal range between lines 148 and 150 is 180° opposed to a median line 158 of the lower pivotal range between lines 152 and 154.

The upper vertical range can be described as extending from a median elevation of table 18 as shown in solid lines in FIG. 1 to an uppermost elevation of table 18 as shown in dashed lines as 18A in FIG. 1 and including all vertical positions therebetween.

The lower vertical range can be defined as extending from the median elevation shown in solid lines in FIG. 1 down to the lowermost elevation shown in dashed lines and represented as 18C in FIG. 1, and all vertical positions therebetween.

The Operation of the Support Structure

FIGS. 13, 13A, and 16 through 18 may be referenced to understand the various methods and operation of the support structure 200 in association with the movement of the table 18. These methods include a method for providing a table 18 over a bed from a side of the bed, a method for compacting an extended bed table apparatus 10, and a method for expanding a compacted bed table apparatus 10.

When it is desired to operate the second embodiment of the invention so that the movement of the table 18 will also extend the support arm 234 or outrigger support 202, the person merely needs to move the table to properly extend the outrigger support 202. This method for providing a table 18 over a bed from a side of the bed includes several key elements. The method includes providing the actual table apparatus 10 which includes a base 12 with an extendable table 18 and an extendable support arm 234 or outrigger support 202 known as a lateral support for this discussion. The table apparatus 10 will then be positioned the base 12 is at the side of the bed. By grasping the table and rotating the table 18 and the attached column 14 in relation to the base 12, the table 18 will be extended outward from the base 12 over the bed. This rotation of the column 14 will also provide for the movement of the lateral support through the rotation of the column 14. By the rotational movement of the table 18 in relation to the base 12, and the associated rotational movement of the column 14 within the base 12, the user will rotate the lateral support underneath the base to extend the support from the base 12 in a direction of the extension of the table 18. While telescoping devices could be utilized for the present invention, for the preferred embodiment, the rotation of the table and the rotation of the lateral support are fixed by the attachment to the column 14 so that the direction of extension of the table 18 and the lateral support are always maintained in a proper relationship. This controlled movement of the lateral support in relation to the movement of the table 18 provides the lateral support for the base 12 and the table apparatus 10. However, each of these could be done separately using a different type of control method. Thus, for this method, it is envisioned that the extension of the table 18 may include the rotation of the table 18 in relation to the base 12 and a separate element may then include the extension of the lateral support arm 202 by rotating the lateral support arm 202 in relation to the base 12. In this manner, the table 18 may be positioned in the overbed position.

The present invention also teaches that the amount of extension of the table 18 and base 12 should be related to provide a correlation between the extension of the lateral support arm in relation to the cantilever overhang of the table 18 over the base 12. This is provided by controlling the amount of extension of the lateral support arm in direct proportion to the amount of extension of the table 18. The fixed lengths of the maximum table extension and support arm 234 of the present invention and the fixed rotations of both the table 18 and lateral support arm 234 automatically provide for the proper lateral support for the base 12 when the table 18 is extended to overhang the base 12.

In addition to the support provided by the lateral support arm 202, the present invention also teaches the provision of an underbody side support for the base such as that provided by the casters 20. If the four corners of the base 12 are supported by fixed position casters 20, it can be seen that the present invention teaches the provision of a side support 20 for the base that is located in an extension path of the lateral support arm 202. An improvement may then be provided by moving the side support 20 in relation to the extension of the lateral support arm 202 such that the extension path is not limited by the side support 20. This is most readily apparent by the movement of the fourth, fifth, and sixth casters 226, 228, 230 shown in FIGS. 13 and 13*a*.

Another method provided by the present invention is a method for compacting an extended bed table apparatus 10. For this method, the bed table apparatus 10 includes an extendable table 18 and an extendable support arm 202 attached to a base 12 as previously described. This method then teaches the positioning of the extendable table 18 over the base 12 and the positioning of the extendable lateral support arm 202 under the base 12. This results in a compacted apparatus 10 that is easily transported.

Finally, another method is taught for expanding a compacted bed table apparatus 10 which utilizes the bed table apparatus 10 including an extendable table 18 and an extendable support arm 234 attached to a base 12. This method teaches the expansion of the apparatus 10 by extending the table 18 outward from the base 12 and extending the lateral support arm 202 from the base 12 in a direction of the extension of the table 18.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A combination bedside and overbed table apparatus, wherein the apparatus is moveably positionable on a floor, comprising:

a base;

a column rotatably attached to the base and extending upward from the base;

a table attached to the column, the table including a cantilever section extending outward from the column, the table being movable by rotation of the column between a bedside position wherein the cantilever section is located directly over the base, and an overbed position wherein the cantilever section overhangs the base; and a support structure rotatably attached to the base and adapted to support the base on the floor, the support structure including a first outrigger support attached to the column and extending outward from the column such that rotation of the table relative to the base transfers this rotation through the column to generate a rotation of the first outrigger support relative to the base, the first outrigger support adapted to provide corresponding lateral support to the base when the cantilever section overhangs the base.

2. The apparatus of claim 1, the first outrigger support comprising a lateral extension member adapted to extend past the base when the cantilever section overhangs the base.

3. The apparatus of claim 1, the first outrigger support including a floor contact member.

4. The apparatus of claim 3, wherein the floor contact member is a caster.

5. The apparatus of claim 1, wherein the table and first outrigger support are adapted to allow a full 360° rotational positioning relative to the base.

6. The apparatus of claim 1, the support structure further comprising:

a second outrigger support attached to the column such that rotation of the table relative to the base generates a related rotation of the second outrigger support relative to the base, the second outrigger support adapted to provide lateral support to a non-cantilever side of the base when the cantilever section overhangs the base.

7. The apparatus of claim 6, the support structure further comprising:

a third outrigger support attached to the column such that rotation of the table relative to the base generates a related rotation of the third outrigger support relative to the base, the third outrigger support adapted to provide a lateral support to the base when the cantilever section is located over the base.

8. The apparatus of claim 7, the support structure further comprising:

a fourth outrigger support attached to the column such that rotation of the table relative to the base generates a related rotation of the fourth outrigger support relative to the base, the fourth outrigger support adapted to provide a lateral support to the base on a side opposite the third outrigger support when the cantilever section is located over the base.

9. A support apparatus for a bedside table apparatus including a base supported off of a floor by at least three base supports, the at least three base supports defining a first support area, the support apparatus comprising:

a base plate rotatably attached to the base within the first support area; and at least one outrigger assembly supportively connected to the base plate and adapted to extend past the first support area during rotation of the base plate to provide a second expanded support area.

10. The apparatus of claim 9, further comprising:

a table rotationally mounted to the base and fixed to the base plate, wherein the rotation of the table to a cantilever position overhanging the first support area induces a corresponding rotation of the outrigger assembly.

11. A method for providing a table over a bed from a side of the bed, the method comprising:

(a) providing a base with an extendable table and an extendable support arm;

(b) positioning the base at the side of the bed;

(c) rotating the table relative to the base and thereby extending the table outward from the base over the bed; and (d) rotating the lateral support arm with the table relative to the base and thereby extending the lateral support arm from the base in a direction of the extension of the table.

12. The method of claim 11, extending the lateral support arm comprising:

controlling the amount of extension of the lateral support arm in direct proportion to the amount of extension of the table.

13. A combination bedside and overbed table apparatus, wherein the apparatus is moveably positionable on a floor, comprising:

a base including a first end and a second end;

a column rotationally mounted to the base at the second end;

a table extendably attached to the column, the table being movable by rotation of the column between a bedside position wherein the table is located directly over the first end of the base, and an overbed position wherein the table overhangs the base;

a base support structure attached to the first end of the base;

a rotational support plate fixably attached to the column and supportatively attached to the base; and a first outrigger support fixably attached to the column such that movement of the table relative to the base generates a related movement of the first outrigger support relative to the base, the first outrigger support adapted to provide lateral support to the base when the table section overhangs the base.

14. The apparatus of claim 13, the base support structure and rotational support plate including casters adapted to roll on the floor.

15. The apparatus of claim 13, further comprising:

a column arm extending outward from the column, wherein the table is extendably attached to the column arm, the table being movable by both rotation of the column and extension of the table on the column arm between a bedside position wherein the table is located directly over the first end of the base, and an overbed position wherein the table overhangs the base.

* * * * *